United States Patent [19]

Remson

[11] 4,401,398

[45] Aug. 30, 1983

[54] SUPPORT STRUCTURE FOR MUDLINE SUSPENSION WELLHEAD

[75] Inventor: Donald R. Remson, Houston, Tex.

[73] Assignee: Western Services International, Inc., Houston, Tex.

[21] Appl. No.: 266,967

[22] Filed: May 26, 1981

[51] Int. Cl.[3] ..... E02B 17/00; E02D 21/00

[52] U.S. Cl. ..... 405/201; 166/367

[58] Field of Search ..... 405/195, 201, 228, 203; 175/7, 9, 220; 166/367

[56] References Cited

U.S. PATENT DOCUMENTS

| | | | |
|---|---|---|---|
| 3,001,594 | 9/1961 | Suderow | 405/201 X |
| 3,107,496 | 10/1963 | Suderow | 405/203 |
| 3,189,093 | 6/1965 | De Vries . | |
| 3,328,969 | 7/1967 | Murphy et al. | 405/228 |
| 3,835,939 | 9/1974 | McEntire | 175/220 X |
| 4,030,310 | 6/1977 | Schirtzinger | 405/195 |
| 4,161,376 | 7/1979 | Armstrong . | |
| 4,244,663 | 1/1981 | Croghan | 405/195 |

FOREIGN PATENT DOCUMENTS

| | | | |
|---|---|---|---|
| 2552191 | 5/1976 | Fed. Rep. of Germany | 405/195 |

*Primary Examiner*—James A. Leppink
*Assistant Examiner*—Beverly E. Hjorth
*Attorney, Agent, or Firm*—Richards, Harris & Medlock

[57] ABSTRACT

A support structure (20) for supporting the freestanding portion of a mudline suspension wellhead includes first and second support arms (56) attached to and extending from an offshore drilling platform (24). The structure is aligned below a cantilevered type drilling derrick (40). A gantry (60) is supported by and slidable relative to these arms. A cradle structure (66) is mounted for lateral movement on the gantry. Structure is provided for positioning the gantry along the longitudinal length of the arms and for positioning the cradle along the longitudinal length of the gantry. Movement of the cradle structure relative to the gantry and of the gantry relative to the support arms defines a zone between the support arms and between the drilling platform and the outermost point of travel of the gantry in which the cradle may be selectively positioned. The gantry and cradle are aligned relative to the wellhead, and structure (290, 320) associated with the cradle is provided for clamping the wellhead thereto.

19 Claims, 6 Drawing Figures

SUPPORT STRUCTURE FOR MUDLINE SUSPENSION WELLHEAD

TECHNICAL FIELD

The present invention relates to a support structure for attachment to a mobile offshore drilling unit for supporting the freestanding portion of a mudline suspension wellhead.

BACKGROUND ART

A new generation of jackup rig, known as the cantilevered type rig, is increasingly being used in offshore drilling of oil wells. In this new generation of oil rigs, a platform is supported from the sea floor by a plurality of legs which normally are jacked relative to the platform until engagement with the sea floor. A main deck is provided by the platform and drilling is performed from a derrick which is positioned in a cantilevered position to one side of the platform. The derrick is movable on skids which permit the derrick to be skidded out in its extended cantilevered position for drilling to one side of the rig platform. In this way, no openings in the platform or main deck are required to permit the drilling operation to be conducted beneath the derrick. When drilling is completed or when the platform is in transit to the drill site, the derrick is skidded in or retracted onto the main deck.

It is also the practice in the use of these new generation rigs to skid in or retract the drilling derrick during severe weather conditions. This precaution is taken to position the derrick in a more secure position and to provide protection from severe storms and ocean activity. In these situations where the derrick is skidded in and drilling is in progress, the wellhead and casing extending above the sea floor are supported by "mudline suspension". In this situation, the exposed wellhead and uppermost casing sections are supported from the floor of the sea. Where the water depth is 100 to 150 feet or greater, this support is insufficient, particularly during storm conditions.

In a conventional (not-cantilever type) drilling unit, some support is provided to the wellhead and the uppermost casing sections by use of support cables attached between the drilling platform and the wellhead. This type of support cannot be provided on a cantilever type rig when the derrick is skidded in over the platform. As a result, wellheads and uppermost casing sections have been lost during storm conditions. Where such damage occurs, substantial losses in man hours, equipment and drilling down time are suffered, and a severe blowout hazard arises.

SUMMARY OF THE INVENTION

The present invention is designed for use with a cantilevered type drilling rig wherein a drilling derrick is movable from a skidded in or retracted position over the drilling platform and a skidded out or extended position cantilevered from the drilling platform. The present invention is directed to a structure for attachment to the drilling platform below the drilling deck and substantially aligned therewith. The structure provides support for the freestanding portion of a mudline suspension wellhead which is drilled by the derrick.

The structure includes first and second support arms attached to and extending from the platform with a gantry supported by and slidable relative to these arms. A cradle structure is mounted for lateral movement on the gantry. Structure is provided for positioning the gantry along the longitudinal length of the arms and for positioning the cradle along the longitudinal length of the gantry. Movement of the cradle structure relative to the gantry and of the gantry relative to the support arms defines a zone between the support arms and between the drilling platform and the outermost point of travel of the gantry in which the cradle may be selectively positioned. This zone encompasses the normal drilling positions of the drilling rig.

This positioning capability permits the selective alignment of the gantry and the cradle relative to the wellhead. Structure associated with the cradle is provided for clamping the wellhead thereto. In this way, the wellhead may be supported from the structure of the present invention where the drilling derrick is disengaged from the wellhead and skidded in onto the drilling platform, such as is the case during severe weather conditions.

In a further embodiment of the present invention, the structure includes a cradle storage structure mounted between the platform and the arms. This cradle storage structure receives the gantry in a stored position adjacent to the platform when the gantry is not in use. In this embodiment of the invention, the arms are hingeable from the cradle storage structure and may be folded back into a stored position against the platform when not in use.

In still a further embodiment of the invention, the means for moving the gantry includes pulleys or sheaves mounted at the end of each arm with cables extending from the gantry and around the pulleys to the platform. Appropriate draw up means is provided for pulling in the cables to move the gantry away from the platform. Cables are also attached between the gantry and draw up means on the platform to permit selective movement of the gantry toward the platform.

In still a further embodiment of the invention, the means for moving the cradle along the longitudinal length of the gantry includes sheave means attached near the opposite ends of the gantry and cables attached to the cradle and around the sheave means. Structure is provided for drawing said cables to move the cradle along the gantry.

In a preferred embodiment of the invention, the arms of the support structure include a truss member formed from an upper and lower channel having a plurality of vertical and diagonal struts attached therebetween. The gantry includes a plurality of rollers on the ends thereof for engagement within tracks formed by the channels permitting movement of the gantry relative to the arms.

When in use, the support structure is stabilized by the attachment of support cables between the ends of the gantry and the point of attachment of the arms to the platform to provide diagonal supports from the gantry to the platform structure. In this way, lateral stability is provided to the structure during use.

In use of the present invention, tension can be applied to the drill casing by initially applying tension on the casing through the use of the drawworks and derrick blocks and clamping of the wellhead using the clamp structure associated with the cradle. The tension on the drilling casing is maintained by the support structure upon release of load initially applied by the drawworks and derrick blocks. This load is supported by the support structure from the drilling platform and is independent of the position of the drilling derrick and associated structure.

With the addition of grating and hand rails, supported by the gantry, the support structure also serves as a work platform to enable servicing of the wellhead and blowout preventer system.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 2:
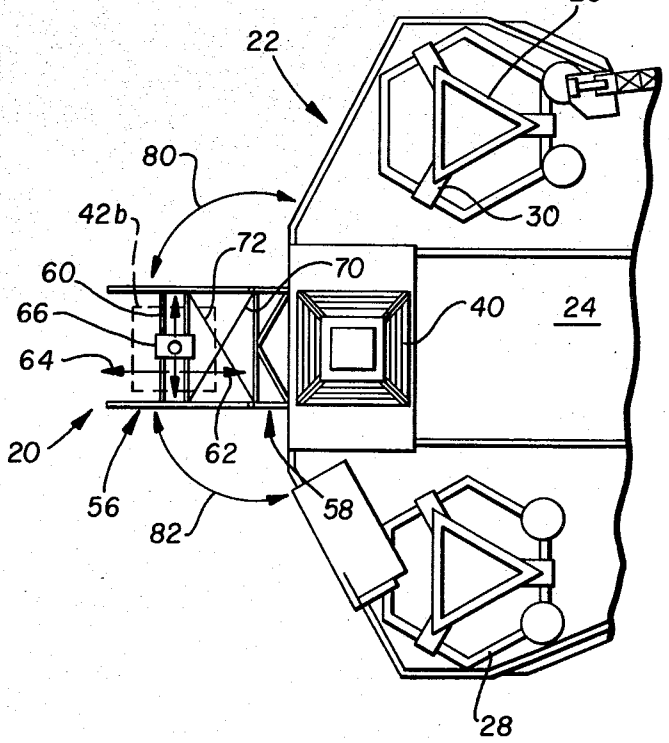
FIG. 2 is a stop plan view of the invention as illustrated in FIG. 1 showing the drilling rig retracted to the transit or stored position.
Figure 1:
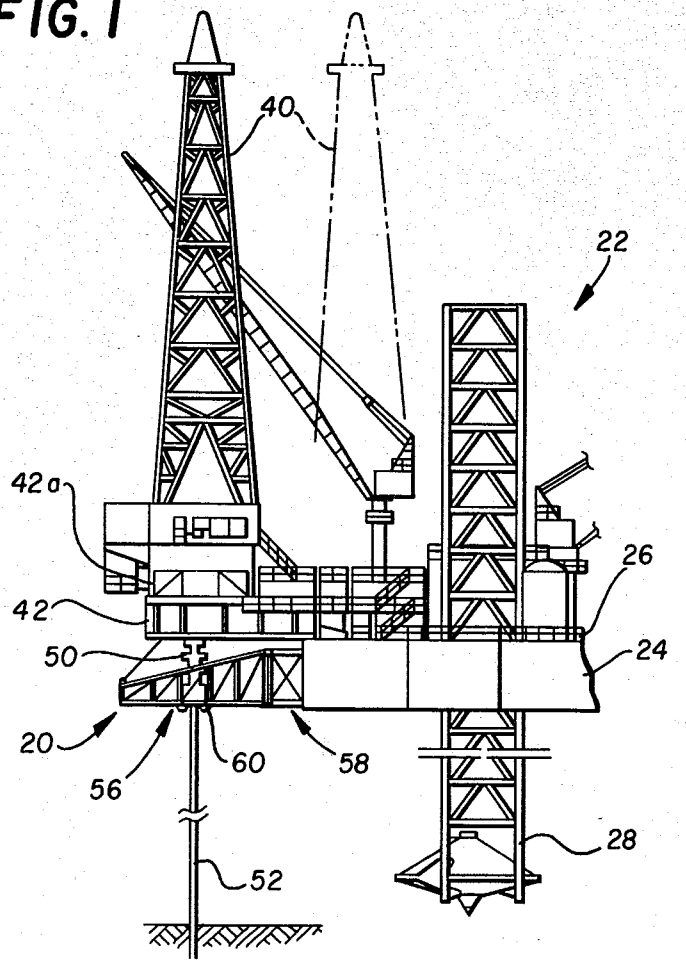
FIG. 1 is a side plan view of a cantilevered type offshore drilling rig incorporating the support structure according to the present invention, and illustrating the drilling rig in the drilling or skidded out position.

Referring to FIGS. 1 and 2, a wellhead support structure 20 is mounted from the stern of a cantilevered type oil rig 22. Rig 22 includes a platform 24 having a main deck 26 and supported from the ocean floor by caisson legs 28. Platform 24 is provided with a plurality of jacking units 30 as is known in the art. Jacking units 30 engage caisson legs 28 for movement of the legs relative to the platform to support the platform from the ocean floor.

The cantilevered type oil rig is so named because of the cantilevered position assumed by the drilling derrick 40 on the stern of the rig.

Derrick 40 is supported by a plurality of skid beams or rails 42 extending from the stern of rig 22. The derrick is movable on beams 42 from a cantilevered position, shown in solid lines in FIG. 1, to a retracted position over platform 24, as is shown in phantom lines in FIG. 1 and in solid lines in FIG. 2. The retracted position is used in severe storm conditions to prevent or minimize possible damage to the derrick.

Derrick 40 is movable fore and aft on the platform as has been indicated. Derrick 40 is also movable port and starboard by movement of substructure 42(*a*) (FIG. 1) which is movable port and starboard on the skid beams. This movement of derrick 40 permits drilling to be carried out, and hence the permitting of the wellhead, anywhere in the area depicted by the dash lines 42*b* (FIG. 2).

In accordance with the present invention, support to the wellhead 50 and the uppermost casing 52 is provided by wellhead support structure 20 which includes a pair of beam trusses 56 hingeably attached to a cradle storage structure 58 rigidly mounted to the stern of platform 24. Referring specifically to FIG. 2, a gantry 60 is mounted for movement toward and away from platform 24 in the direction of arrows 62 and 64. A cradle structure 66 is mounted for movement port and starboard along gantry 60. A pair of lateral support cables 70 and 72 are attached in a cross pattern between the end of gantry 60 and cradle storage structure 58 to provide lateral support to the wellhead support structure. With the gantry 60 retracted against platform 24 and situated in the cradle storage structure 58, beam truss 56 may be hinged back against platform 24 as indicated by arrows 80 and 82 and as will be described hereinafter in greater detail.

Figure 3:
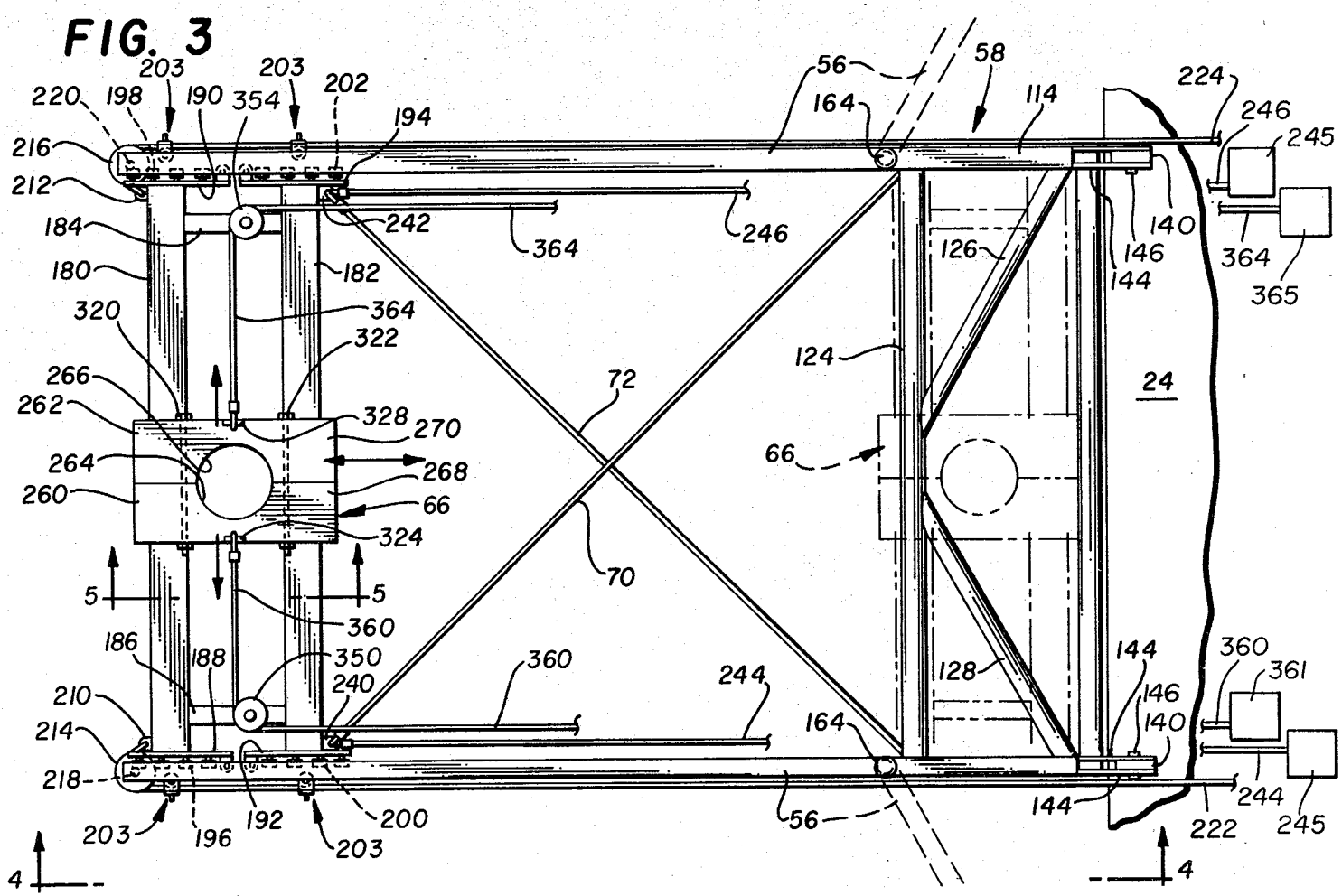
FIG. 3 is a top plan view of the support structure of the present invention.
Figure 4:
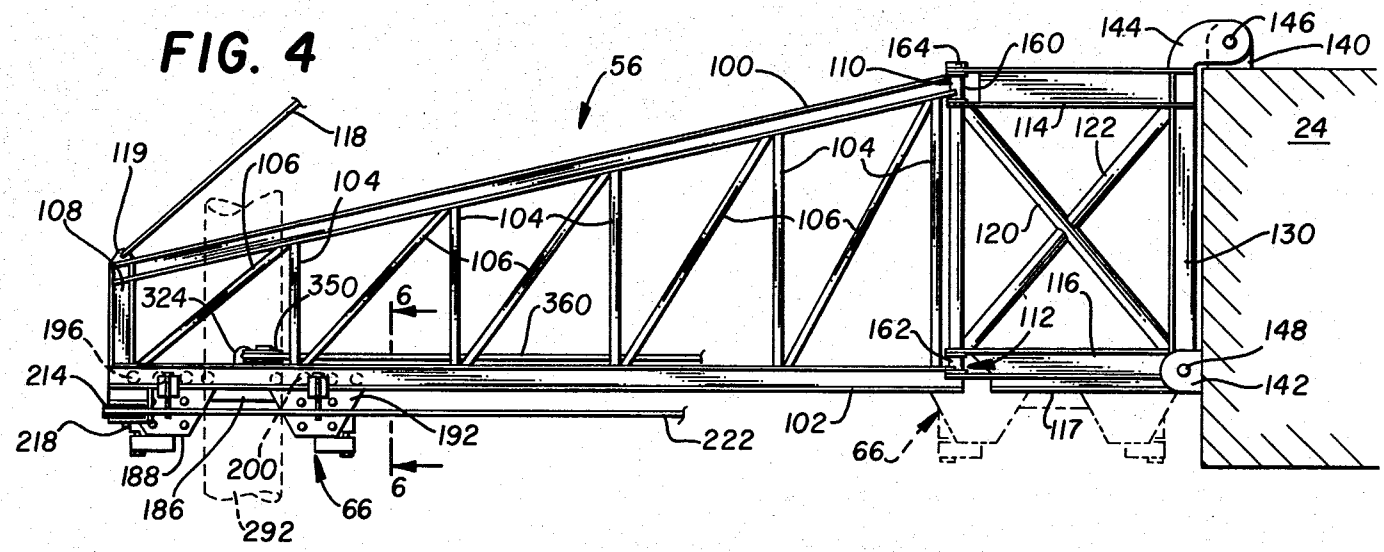
FIG. 4 is a side plan view of the support structure according to the present invention as seen from lines 4—4 of FIG. 3.

Referring now to FIGS. 3 and 4, a more detailed disclosure of the wellhead support structure according to the present invention is disclosed. As is best seen in FIG. 4, each beam truss 56 includes an upper I-beam 100 and a lower I-beam 102 connected by a plurality of vertical truss members or struts 104, diagonal truss members or struts 106 and an end beam 108. Each boom truss 56 is hinged at sleeve joints 110 and 112 at their connections to upper and lower beams 114 and 116, respectively, of cradle storage structure 58. The ends of the beam truss 56 remote from their points of connection to the cradle storage structure 58 are additionally supported by cables 118 which are attached between lugs 119 fixed to truss 56 and the rig superstructure.

Referring specifically to FIGS. 3 and 4, cradle storage structure 58 includes upper and lower beams 114 and 116 maintained in a spaced parallel relationship by cross members 120 and 122 and separated by lateral beam 124 and struts 126 and 128 attached from the approximate midpoint of beam 124 and beam 130 which is engaged against platform 24. Cradle storage structure 58 is attached to platform 24 of rig 22 at appropriate lugs 140 and 142 extending from platform 24. Lugs 140 are engaged by appropriate fittings 144 extending from upper beam 114. Attachment is by way of pin 146. Lower lug 142 is attached by an appropriate pin 148 to lower beams 116.

Sleeve joints 110 and 112 may be of any design capable of supporting the pivotal movement of beam truss 56 relative to cradle storage structure 58. In the embodiment shown, both the upper and lower beams 114 and 116 have a portion of the I-beam web cut away leaving an upper and lower strap for receiving cylinder structures 160 and 162 therein. An appropriate shaft 164 is engaged through cylinders 160 and 162, as well as the end caps of beams 114 and 116 positioned to both sides of the cylinders to complete the hinged arrangement. The cap of shaft 164 is shown in FIG. 3 and in FIG. 4.

Figure 5:
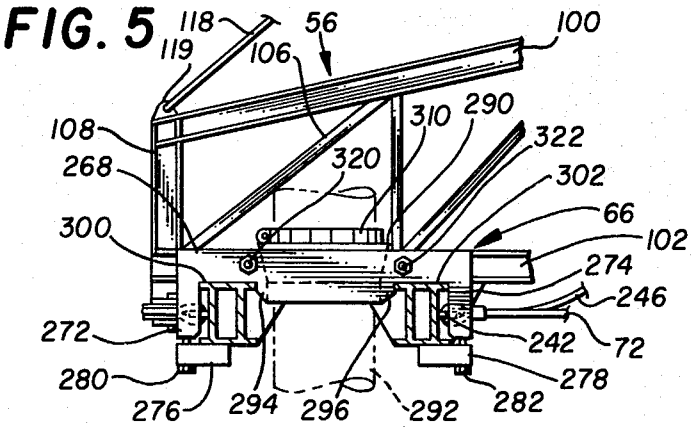
FIG. 5 is a section view taken along line 5—5 of FIG. 3.
Figure 6:
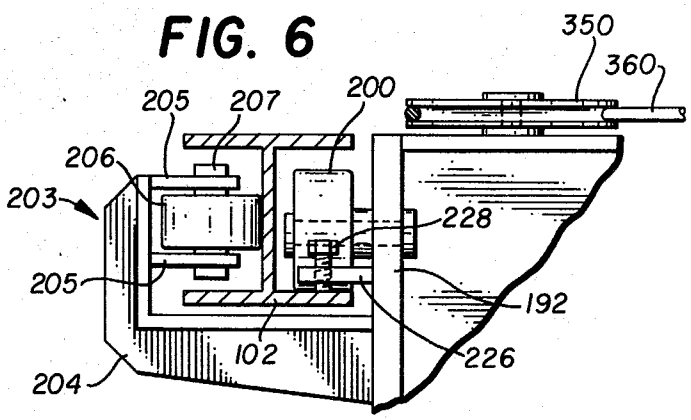
FIG. 6 is a section view taken along line 6—6 of FIG. 4.

Referring still to FIGS. 3 and 4 in conjunction with FIGS. 5 and 6, gantry 60 is shown in greater detail. Gantry 60 includes a pair of parallel I-beams 180 and 182 maintained in a spaced relation by spacer bars 184 and 186 attached therebetween at opposite ends thereof.

Spacer bars 184 and 185 are removably attached between I-beams 180 and 182 such as by bolting the end of bars 184 and 186 thereto. In this way, the beams 180 and 182 may be separated as is discussed in greater detail hereinafter.

End plates 188 and 190 are mounted to opposite ends of I-beam 180 of gantry 60 and end plates 192 and 194 are attached to the ends of I-beam 182 of gantry 60. A plurality of rollers 196 are mounted to end plate 188 by way of appropriate shafts. Similarly, a plurality of rollers 198 are mounted to end plate 190. A plurality of rollers 200 and 202 are mounted to end plates 192 and 194, respectively. As is best seen in FIGS. 4 and 6, these rollers are received within the channel opening of lower beam 102 of beam truss 56. As a result, gantry 60 may be moved along the longitudinal length of beam truss 56 as a result of the rolling engagement between rollers 196, 198, 200 and 202 with the lower beam 102.

Lateral stability during movement of the gantry is provided by hook roller assemblies 203 extending from end plates 192, 194, 196 and 198. Hook roller assemblies 203 are identical one to the other and are best shown in the section view of FIG. 6. Each assembly 203 includes an L-shaped arm 204 extending from end plates 192, 194, 196 and 198 and has a pair of spaced parallel roller support arms 205 extending inwardly as shown. A roller 206 is supported for rotation between arms 205 on an appropriate shaft 207. As can be appreciated from a review of the positioning of hook roller assemblies 203, movement of the gantry relative to lower I-beams 102 is facilitated by the positioning of rollers 206 for selective engagement with the channel web as the gantry is moved relative to the I-beam.

A locking clamp structure is also provided including a lug 226 extending outwardly from end plate 192 having an appropriate bolt 228 threaded therethrough. As can be seen in FIG. 6, by advancing bolt 228, a clamping force may be applied against the lower leg of I-beam 102, the leg being clamped between the end of bolt 228 and the horizontally extending portion of hook roller arm 204.

Movement of gantry 60 is accomplished in the following manner. Padeyes 210 and 212 are mounted adjacent the ends of I-beam 180. Sheaves 214 and 216 are mounted for rotation about axis pins 218 and 220 attached to lower beams 102. A cable 222 is attached from padeye 210 and is engaged around sheave 214 and carried back to oil rig 22 for attachment to a takeup mechanism (not shown). Similarly, a cable 224 is attached to padeye 212 and engaged around sheave 216 and thereafter routed back to oil rig 22 and an appropriate takeup mechanism.

Further, padeyes 240 and 242 are attached adjacent the opposite ends of I-beam 182 facing oil rig 22 and receive cables 244 and 246 attached thereto. The ends of cables 244 and 246 are directed to an appropriate takeup mechanism, such as winches 245, on oil rig 22. As will readily be appreciated, by drawing in cables 244 and 246, gantry 60 is translated inwardly toward platform 24. Alternatively, by drawing in cables 222 and 224, gantry 60 is translated away from platform 24.

With the gantry 60 positioned at a desired location relative to beam truss 56, its position is fixed by securing cables 244, 246, 222 and 224 to prevent movement thereof. Lateral stability is provided by the use of cables 70 and 72 (FIG. 3). One end of cable 70 is attached to padeye 240 by appropriate clamp structure with the opposite end being tied off to port side beam 116 of cradle storage structure 58. Cable 72 is attached at one of its ends to padeye 242 by an appropriate attachment fitting with its opposite end being tied off to starboard side beam 116 of cradle storage structure 58. The attachment of these cables to the port and starboard side beams 116 is by any conventional means such as clamping. An appropriate tension is applied to the cables prior to being tied off to provide sufficient lateral stability to the beam truss 56.

As will be appreciated, prior to moving gantry 60, cables 70 and 72 are disconnected from their point of attachment to beams 116, with the gantry then being moved to any desired alternate position. When in place, cables 70 and 72 are again tied off as described above to provide lateral stability and prevent movement of beam truss 56 from the position shown in FIG. 3.

Referring now specifically to FIG. 3 and FIG. 6, cradle 66 is mounted for movement port and starboard on I-beams 180 and 182. Cradle 66 consists of two mirror image halves 260 and 262, each having semicircular cutouts 264 and 266, respectively, formed in one side thereof. Each half has a top section 268 and 270, respectively, with a pair of downwardly extending legs 272 and 274. Lockdown plates 276 and 278 are attached to the free ends of legs 272 and 274 by appropriate bolts 280 and 282, respectively. A pair of ears 294 and 296 extend downwardly from top sections 268 and 270 to form receiving channels 300 and 302 of sufficient width to receive I-beams 180 and 182 therein.

The cutouts 264 and 266 are tapered as is shown in FIG. 5 to receive segmented slips 290 for engagement against casing section 292. A safety clamp 310 is engaged to casing section 292 to assure engagement of the segmented slips against the section as is well known in the art.

Cradle halves 260 and 262 are secured one to the other by appropriate bolts 320 and 322 which extend the full width of cradle halves 260 and 262. Thus, cradle halves 260 and 262 may be separated or drawn together as desired by disengagement or engagement of bolts 320 and 322.

A padeye 324 is attached to cradle half 260 at the upper surface thereof. Similarly, a padeye 328 is attached to cradle half 262 along the upper surface thereof. Padeye 324 and 328 are mounted substantially intermediate of the fore and aft ends of the cradle halves. A horizontal snatch block 350 is mounted on the upper surface of bar 186 intermediate of I-beams 180 and 182. A horizontal snatch block 354 is mounted on the upper surface of bar 184 intermediate of I-beams 180 and 182. A cable 360 is attached at one of its ends to padeye 324 by an appropriate clamp fitting and engaged around snatch block 350 with its opposite end attached to an appropriate airhoist (not shown) on platform 24 for selective retraction of cable 360. Similarly, cable 364 is attached at one of its ends to padeye 328 and is engaged around snatch block 354 with its opposite end attached on airhoist (not shown) on platform 24. As will be appreciated, movement of cradle 66 port along the longitudinal length of gantry 60 is accomplished by drawing in cable 364 using winch 365. Moving cradle 66 starboard along gantry 60 is accomplished by drawing in cable 360 using winch 361.

Under tow conditions or where employment of the present invention is not desired, the support structure provided by the invention may be stored. In this position, gantry 60 will be drawn inwardly toward platform 24 to a stored location within cradle storage structure 58. This stored position, illustrated in phantom in FIGS. 3 and 4, is simply and easily assumed by drawing in cables 244 and 246 causing the gantry to translate on rollers 196, 198, 200 and 202 along lower beams 102 of beam truss 56. Cradle storage structure 58 is designed with a pair of beams 117 which are identical to and aligned with beams 102. Thus, the movement of gantry 60 onto cradle storage structure 58 is accomplished by the continuous movement of gantry 60 along lower beams 102 onto lower beam 117 of cradle storage structure 58. With cradle 66 in its stored position on cradle storage structure 58, beam truss 56 may be pivoted about sleeve joints 110 and 112 to a position adjacent platform 24. Alternatively, beam truss 56 may be removed by removing shafts 164 which provide the connection between beam truss 56 and beams 114 and 116 of cradle storage structure 58.

During normal drilling operations, gantry 60 and cradle 66 are positioned immediately below the rotary table on the drilling platform. This is accomplished by hinging beam truss 56 outwardly to the position illustrated in FIG. 3 and drawing gantry 60 outwardly to the desired position therealong using cables 222 and 224. With the gantry properly positioned along the longitudinal length of beams 102, cables 70 and 72 are engaged to beams 116 as hereinbefore described and tied off to provide lateral stability to the support structure.

During the drilling operation, cradle halves 260 and 262 are slightly separated to permit drilling to be conducted between these components, as well as between I-beams 180 and 182 of gantry 60.

In those situations where additional support of the wellhead is required, such as when the drilling derrick must be skidded in during severe weather conditions, the present invention is employed to provide such support. The cradle halves are drawn together by bolts 320 and 322 and by use of segmented slips 290 and safety clamp 310, casing 292 is secured between cradle halves 260 and 262. The cradle is further locked to I-beam 180 and 182 of gantry 60 by the engagement of bolts 280 and 282 to entrap I-beams 180 and 182 between channels 300 and 302 formed by the cradle and lockdown plates 276 and 278, respectively.

With this structure is place, positive support is provided to the wellhead directly from the main platform. Loads induced as a result of forces on the wellhead are taken into the platform structure and are not transferred to the drilling derrick or the derrick skid beams.

In some cases, applying a tension to the drill string or casing will be desired. In this situation, a tension is applied to the drill string or casing by use of airhoist or drilling drawworks and derrick on the drill floor prior to clamping the casing into the cradle. Safety clamp 310 assures the retention of such tension in the drill string by preventing slippage of the casing relative to the cradle.

With the introduction of the new generation of cantilevered drilling rigs similar to that disclosed in the present invention, severe damage has been sustained to the wellhead and the uppermost casing where the drilling derrick is skidded in during emergency or severe storm conditions. In the past, with the derrick disconnected from the wellhead, the wellhead was suspended and supported only at the mudline or sea bottom. Where drilling is conducted in water depths of 100 to 150 feet or greater, such support has been inadequate to prevent damage and failure to the wellhead in many situations.

In these cases, attempts to prevent such damage or failure have included the use of support cables and struts fabricated of pipe and secured to the main deck extended from either the skid beams or the platform to the wellhead. However, these cable and strut supports have been ineffective in limiting the movement and subsequent damage to the wellhead and uppermost casing sections during severe weather conditions or other emergencies where the drilling derrick has had to be disengaged from the wellhead.

The present invention provides such support by way of a movable cradle which may be positioned within a clamp zone defined by the positions made available by movement of the cradle port and starboard along the gantry and the gantry inboard and outboard along boom trusses relative to the main platform. Moreover, the present invention provides such a support structure which may be easily stored adjacent the main platform or removed completely. Alternatively, the present support structure may be used as a casing stabbing guide, as well as a base for a work platform below the main drilling floor.

In an emergency situation, it may be desirable to completely disconnect from the wellhead. This is accomplished in the following manner. Cradle 66 is released from the wellhead by unbolting bolts 320 and 322 holding cradle halves 260 and 262 together. Cradle halves 260 and 262 are withdrawn from the gantry upon removal of locking plates 276 and 278 (FIG. 5). I-beam 180 is separated from I-beam 182 of gantry 60 by disconnecting spacer bars 184 and 186. By drawing in cables 222 and 224 (FIG. 3) attached to I-beam 180, I-beam 180 is drawn completely off of beams 102. I-beam 180 may be secured to the platform by an appropriate keeper cable (not shown) for later retrieval. I-beam 182 is drawn inwardly into the cradle storage position by drawing in cables 244 and 246 (FIG. 3).

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A structure for attachment to an offshore drilling platform for supporting the freestanding portion of a mudline suspension wellhead comprising:

first and second support arms attached to and extending from the platform, said arms being independently hingeable from said platform and movable from a stored position against said platform to a working position extending from said platform, a gantry supported by and slidable relative to said arms when said arms are in the working position, a cradle structure mounted for lateral movement on said gantry, means for positioning said gantry along the longitudinal length of said arms when said arms are in the working position and for positioning said cradle along the longitudinal length of said gantry to selectively align said gantry and cradle structure relative to the wellhead, and means associated with said cradle structure for clamping said wellhead.

2. The structure according to claim 1 wherein said means for moving said gantry includes:

sheave means mounted at the end of each said arm with first cable means extending from said gantry around said sheave means and to said platform, second cable means attached between said gantry and said platform, and means for drawing in said first and second cable means to move said gantry toward and away from said platform.

3. The structure according to claim 1 wherein said means for moving said cradle along the longitudinal length of said gantry includes:

sheave means mounted near the opposite ends of said gantry, cable means having one end attached to said cradle and engaged around said sheave means, and means for drawing the opposite end of said cable means to move said cradle along said gantry.

4. The structure according to claim 1 wherein said arms include an inwardly facing channel member, each said channel member forming an inwardly facing track, and wherein said gantry includes a plurality of rollers extending from the ends thereof for engagement within the tracks formed by said channels for movement along said channel members.

5. Structure for supporting a wellhead positioned to one side of a drilling platform, comprising:

a frame structure comprising first and second support arms independently hingeable to and extending from the platform, a gantry supported by said frame structure and movable to and from said drilling platform by movement on said frame structure, a cradle structure mounted for movement on said gantry substantially transverse to the movement provided by said gantry relative to said frame structure, means for positioning said gantry relative to said frame structure and for positioning said cradle relative to said gantry to selectively align said cradle structure relative to the wellhead, and means associated with said cradle structure for clamping said wellhead.

6. The structure according to claim 5 wherein said means for moving said gantry includes:

sheave means mounted at the end of each said arm with first cable means extending from said gantry around said sheave means and to said platform, second cable means attached between said gantry and said platform, and means for drawing in said cables to move said gantry toward and away from said platform.

7. The structure according to claim 5 wherein said means for moving said cradle along the longitudinal length of said gantry includes:

sheave means mounted near the opposite ends of said gantry, cable means attached to said cradle and around said sheave means, and means for drawing said cables to move said cradle along said gantry.

8. The structure according to claim 5 wherein said arms include an inwardly facing channel member, each said channel member forming an inwardly facing track, and wherein said gantry includes a plurality of rollers extending from the ends thereof for engagement within the tracks formed by said channels for movement along said channel members.

9. The structure according to claim 5 further comprising support cables for attachment between the ends of said gantry and the platform to provide lateral stability to said arms.

10. In a cantilevered type drilling rig wherein a drilling derrick is movable from a skidded in position over a main platform and a cantilevered position wherein the derrick is skidded out from the platform, a structure for supporting the wellhead of a drill string worked by the drill rig in its cantilevered position, comprising:

a frame structure comprising first and second support arms independently hingeable to and extending from the platform, a gantry supported by said frame structure and slidable to and from said drilling platform by movement on said frame structure, a cradle structure mounted for movement on said gantry transverse to the movement provided by said gantry relative to said frame structure, means for positioning said gantry relative to said frame structure and for positioning said cradle relative to said gantry to relatively align said cradle structure relative to the wellhead, and means associated with said cradle structure for clamping said wellhead.

11. The structure according to claim 10 wherein said means for moving said gantry includes:

sheave means mounted at the end of each said arm with first cable means extending from said gantry around and sheave means and to said platform, second cable means attached between said gantry and said platform, and means for drawing in said cables to move said gantry toward and away from said platform.

12. The structure according to claim 11 further comprising support cables for attachment between the ends of said gantry and said cradle storage structure to provide lateral stability to said arms.

13. The structure according to claim 10 wherein said means for moving said cradle along the longitudinal length of said gantry includes:

sheave means mounted near the opposite ends of said gantry, cable means having an end attached to said cradle and around said sheave means, and means for drawing the opposite end of said cable means to move said cradle along said gantry.

14. The structure according to claim 10 wherein said arms include an inwardly facing channel member, each said channel member forming an inwardly facing track, and wherein said gantry includes a plurality of rollers extending from the ends thereof for engagement within the tracks formed by said channels for movement along said channel members.

15. A structure for attachment to an offshore drilling platform for supporting the freestanding portion of a mudline suspension wellhead comprising:

a cradle storage structure mounted to said platform, first and second support arms attached to and extending from said cradle storage structure, said arms being independently hingeable from said cradle storage structure for selectively hinging said arms against the drillingn platform, a gantry supported by and slidable relative to said arms and receivable onto the cradle storage structure for storage thereof, a cradle structure mounted for lateral movement on said gantry, means for positioning said gantry along the longitudinal length of said arms and for positioning said cradle along the longitudinal length of said gantry to selectively align said gantry and cradle structure relative to the wellhead, and means associated with said cradle structure for clamping said wellhead.

16. The structure according to claim 15 further comprising support cables for attachment between the ends of said gantry and said cradle storage structure to provide lateral stability to said arms.

17. A structure for attachment to an offshore drilling platform for supporting the freestanding portion of a mudline suspension wellhead comprising:

first and second support arms attached to and extending from the platform, a gantry supported by and slidable relative to said arms, cradle storage structure mounted between said platform and said arms, for receiving said gantry, said arms being hingeable from said cable storage structure for selectively hinging said arms against the drilling platform, cradle structure mounted for lateral movement on said gantry, means for positioning said gantry along the longitudinal length of said arms and for positioning said cradle along the longitudinal length of said gantry to selectively align said gantry and cradle structure relative to the wellhead, means associated with said cradle structure for clamping said wellhead, and a first stabilizing cable attached between the end of said gantry adjacent said second support arm and said cradle storage structure adjacent the point of attachment of said first arm to said storage structure and a second cable attached between the end of said gantry adjacent said first support arm and to said storage structure adjacent the attachment of said second arm to said storage structure.

18. A method for supporting the freestanding portion of a mudline suspension wellhead from an offshore platform having a cantilevered type drilling rig, comprising:

mounting a frame structure comprising first and second support arms independently hingeable to the platform below the cantilevered rig, positioning the support arms such that the arms are in a woking position extending outwardly from the platform, mounting a movable gantry for sliding engagement on the support arms, mounting a slidable cradle structure on the gantry for movement along the longitudinal length of the gantry, moving the gantry on the support arms toward and away from the platform to align the gantry with the wellhead, moving the cradle on the gantry to align the cradle with the wellhead, and clamping the wellhead within the cradle.

19. The method according to claim 18 further comprising:

applying a tension to the wellhead prior to clamping the wellhead in the cradle.

* * * * *

UNITED STATES PATENT AND TRADEMARK OFFICE

CERTIFICATE OF CORRECTION

PATENT NO. : 4,401,398

DATED : August 30, 1983

INVENTOR(S) : Donald R. Remson

It is certified that error appears in the above-identified patent and that said Letters Patent is hereby corrected as shown below:

Column 3, line 18, change "stop" to —top—

Column 3, line 57, change "permitting" to —positioning—

Column 4, line 53, change "185" to —186—

Column 6, line 29, change "Padeye" to —Padeyes—

Column 7, line 25, change "I-beam" to —I-beams—

Column 10, line 9, change "relatively" to —selectively—

Column 10, line 17, change "and sheave" to —said sheave—

Column 11, line 10, change "cable" to —cradle—

Column 12, line 11, change "woking" to —working—

Signed and Sealed this

*Twenty-second* Day of *November 1983*

[SEAL]

*Attest:*

GERALD J. MOSSINGHOFF

*Attesting Officer*

*Commissioner of Patents and Trademarks*